US006311616B1

(12) United States Patent
Kamoda

(10) Patent No.: US 6,311,616 B1
(45) Date of Patent: Nov. 6, 2001

(54) PRINTING MACHINE

(75) Inventor: Hiroyoshi Kamoda, Higashikatsushika-gun (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/551,604

(22) Filed: Apr. 17, 2000

(30) Foreign Application Priority Data

Apr. 19, 1999 (JP) ..... 11-110324

(51) Int. Cl.[7] ..... B41F 5/18
(52) U.S. Cl. ..... 101/216; 101/174; 101/232
(58) Field of Search ..... 101/174, 183, 101/216, 217, 232

(56) References Cited

U.S. PATENT DOCUMENTS 5,927,198 * 7/1999 Tada ..... 101/232
6,050,188 * 4/2000 Bolza-Schunemann ..... 101/183

FOREIGN PATENT DOCUMENTS 43474C 6/1888 (DE) .
841292C 4/1952 (DE) .
2114416A 9/1972 (DE) .
4218422A 12/1993 (DE) .
4303797A 8/1994 (DE) .
0286317A 10/1888 (EP) .
564212A 12/1923 (FR) .
WO9702143A 1/1997 (WO) .

* cited by examiner

*Primary Examiner*—John S. Hilten
*Assistant Examiner*—Kevin D. Williams

(57) ABSTRACT

A stamp cylinder, upstream number cylinder, downstream number cylinder and a paper discharge cylinder are respectively arranged with respect to an impression cylinder so that a distance between the stamp cylinder and the upstream number cylinder has a length equal to or more than a length of a sheet paper. Also, a distance between the downstream cylinder and the paper discharge cylinder has a length equal to or more than a length of a sheet paper. Further, a distance between the stamp cylinder and the downstream number cylinder has a length equal to or less than a length obtained by adding a length of the effective surface of the impression cylinder to twice a length of the notch portion of the impression cylinder.

4 Claims, 5 Drawing Sheets

CONVENTIONAL ART

PRINTING MACHINE

BACKGROUND OF THE INVENTION

1. Field of the Invention

The present invention relates to a printing machine, and particularly to a printing machine which is effective in an application to a case of printing a bill, a paper money and the like.

2. Description of the Prior Art

FIG. 5 shows an outline of a structure of an embodiment of a conventional printing machine which prints a bill and a paper money.

As shown in FIG. 5, a paper stack table 111 is provided in a paper supply portion 110. A feeder board 112 which supplies a sheet paper 100 on the paper stack table 111 to a printing portion 120 one by one is provided in the paper supply portion 110. A swing apparatus 113 which transfers the sheet paper to a transfer cylinder 121*a* is provided in a front end of the feeder board 112.

The transfer cylinder 121*a* is oppositely brought into contact with an impression cylinder 122*a* in the printing portion 120 via transfer cylinders 121*b* and 121*c*. A stamp cylinder 123 for printing a stamp is oppositely brought into contact with the impression cylinder 122*a*. A group of rollers of an ink supply apparatus 124 are oppositely brought into contact with the stamp cylinder 123. Number cylinders 125*a* and 127*a* for printing a number are oppositely brought into contact with the impression cylinder 122*a*. A group of rollers of an ink supply apparatus 126*a* are oppositely brought into contact with the number cylinders 125*a* and 127*a*. A transfer cylinder 121*d* is oppositely brought into contact with the impression cylinder 122*a*. An impression cylinder 122*b* is oppositely brought into contact with the transfer cylinder 121*d*. Number cylinders 125*b* and 127*b* for printing a number are oppositely brought into contact with the impression cylinder 122*b*. A group of rollers of an ink supply apparatus 126*b* are oppositely brought into contact with the number cylinders 125*b* and 127*b*. A paper discharge cylinder 129 is oppositely brought into contact with the impression cylinder 122*b*.

A sprocket 131 is coaxially provided in the paper discharge cylinder 129. Further, a sprocket 132 is provided in a paper discharge portion 130. A paper discharge chain 133 is wound and extended between the sprockets 131 and 132. A plurality of paper discharge gripper 134 are provided in the paper discharge chain 133 at a predetermined interval. Piles 135*a* to 135*c* on which the printed sheet papers 100 are stacked are provided in the paper discharge portion 130.

In the printing machine structured in the manner mentioned above, when the sheet paper 100 is transferred from the paper stack table 111 of the paper supply portion 110 to the transfer cylinder 121*a* via the feeder board 112, the sheet paper 100 is transferred to the impression cylinder 122*a* of the printing portion 120 via the transfer cylinders 121*b* and 121*c*, is printed the stamp by the stamp cylinder 123, is printed the number by the number cylinders 125*a* and 127*a*, is subsequently transferred to the impression cylinder 122*b* via the transfer cylinder 121*d*, is printed the number by the number cylinders 125*b* and 127*b*, thereafter is supplied to the paper discharge gripper 134 of the paper discharge portion 130 via the paper discharge cylinder 129, is transferred together with a travel of the paper discharge chain 133, and is discharged to the pile 135*a* to 135*c*.

In the conventional printing machine as mentioned above, there has been the following problems.

(1) Since the number is printed by the number cylinder 125*a* while the stamp is printed on the sheet paper 100 by the stamp cylinder 123, the printing by the stamp cylinder 123 is slightly shifted due to a little vibration generated at a time of printing the number by the number cylinder 125*a*, so that there is a risk of generating a lost paper.

(2) Since the sheet paper 100 is transferred from the impression cylinders 122*a* and 122*b* to the transfer cylinder 121*d* or the paper discharge cylinder 129 while the number is printed on the sheet paper 100 by the number cylinders 127*a* and 127*b*, a terminal end side of the sheet paper 100 is tensioned by the number cylinders 127*a* and 127*b* by an ink during a printing operation of the ink at a time of transferring and the transfer cylinder 121*d* and the paper discharge cylinder 129 ail to grip the sheet paper 100, thereby dropping down the sheet paper 100. Otherwise, the terminal end side of the sheet paper 100 is tensioned to a side of the transfer cylinder 121*d* or a side of the paper discharge cylinder 129 during a printing operation of the number and a failure of printing the number is generated, so that there is a risk of generating a lost paper.

Accordingly, there has been desired a printing machine which can prevent a sheet-like material such as the sheet paper 100 from being lost as much as possible.

SUMMARY OF THE INVENTION

In order to solve the problems mentioned above, in accordance with the present invention, there is provided a printing machine comprising:

a rotatable impression cylinder which has a plurality of effective surfaces for holding a sheet-like material along a peripheral direction at a predetermined interval;

a first printing portion which is oppositely brought into contact with the impression cylinder and applies a printing to the sheet-like material;

a second printing portion which is oppositely brought into contact with the impression cylinder in a downstream side in a rotational direction of the impression cylinder with respect to an oppositely contacting position of the first printing portion with the impression cylinder and applies a printing to the sheet-like material;

a number printing portion which is oppositely brought into contact with the impression cylinder in a downstream side in the rotational direction of the impression cylinder with respect to an oppositely contacting position of the second printing portion with the impression cylinder and applies a number printing to the sheet-like material; and a transfer cylinder which is oppositely brought into contact with the impression cylinder in a downstream side in a rotational direction of the impression cylinder with respect to an oppositely contacting position of the number printing portion with the impression cylinder and receives the sheet-like material from the impression cylinder, wherein the first printing portion, the second printing portion, the number printing portion and the transfer cylinder are respectively arranged so that a transfer distance of the sheet-like material which is performed by the impression cylinder between the oppositely contacting position between the first printing portion and the impression cylinder and the oppositely contacting position between the second printing portion and the impression cylinder has a length equal to or more than a length in a transfer direction of the printing surface of the sheet-like material, a transfer distance of the sheet-like material which is performed by the impression cylinder between the oppositely contacting position between the number printing portion and the impression cylinder and the oppositely contacting position between the transfer cylinder and the impression cylinder has a length equal to or more than the length in a transfer direction of the printing surface of the sheet-like material, and a transfer distance of the sheet-like material which is performed by the impression cylinder between the oppositely contacting position between the first printing portion and the impression cylinder and the oppositely contacting position between the number printing portion and the impression cylinder has a length equal to or less than a length obtained by adding twice a length between the adjacent effective surfaces of the impression cylinder to a length of the effective surface.

In the printing machine mentioned above, it is characterized in that the impression cylinder is a plural diameter cylinder which has a plurality of effective surfaces for holding the sheet-like material along a peripheral direction at a predetermined interval, and each of cylinders in the first printing portion, the second printing portion and the number printing portion which are oppositely brought into contact with the impression cylinder is a single surface cylinder which has a single effective surface.

In the printing machine mentioned above, it is characterized in that the second printing portion applies a number printing to the sheet-like material.

In the printing machine mentioned above, it is characterized in that an angle formed by a line obtained by linearly connecting the oppositely contacting position between the first printing portion and the impression cylinder to an axial center of the impression cylinder, and a line obtained by linearly connecting the oppositely contacting position between the number printing portion and the impression cylinder to the axial center of the impression cylinder is equal to or less than 180 degrees.

DESCRIPTION OF THE PREFERRED EMBODIMENTS

A description will be given of an embodiment of a printing machine in accordance with the present invention with reference to FIGS. 1 and 2. In this case, FIG. 1 is a schematic view of an outline of a whole of the printing machine and FIG. 2 is an enlarged view which extracts a main portion of FIG. 1.

Figure 1:
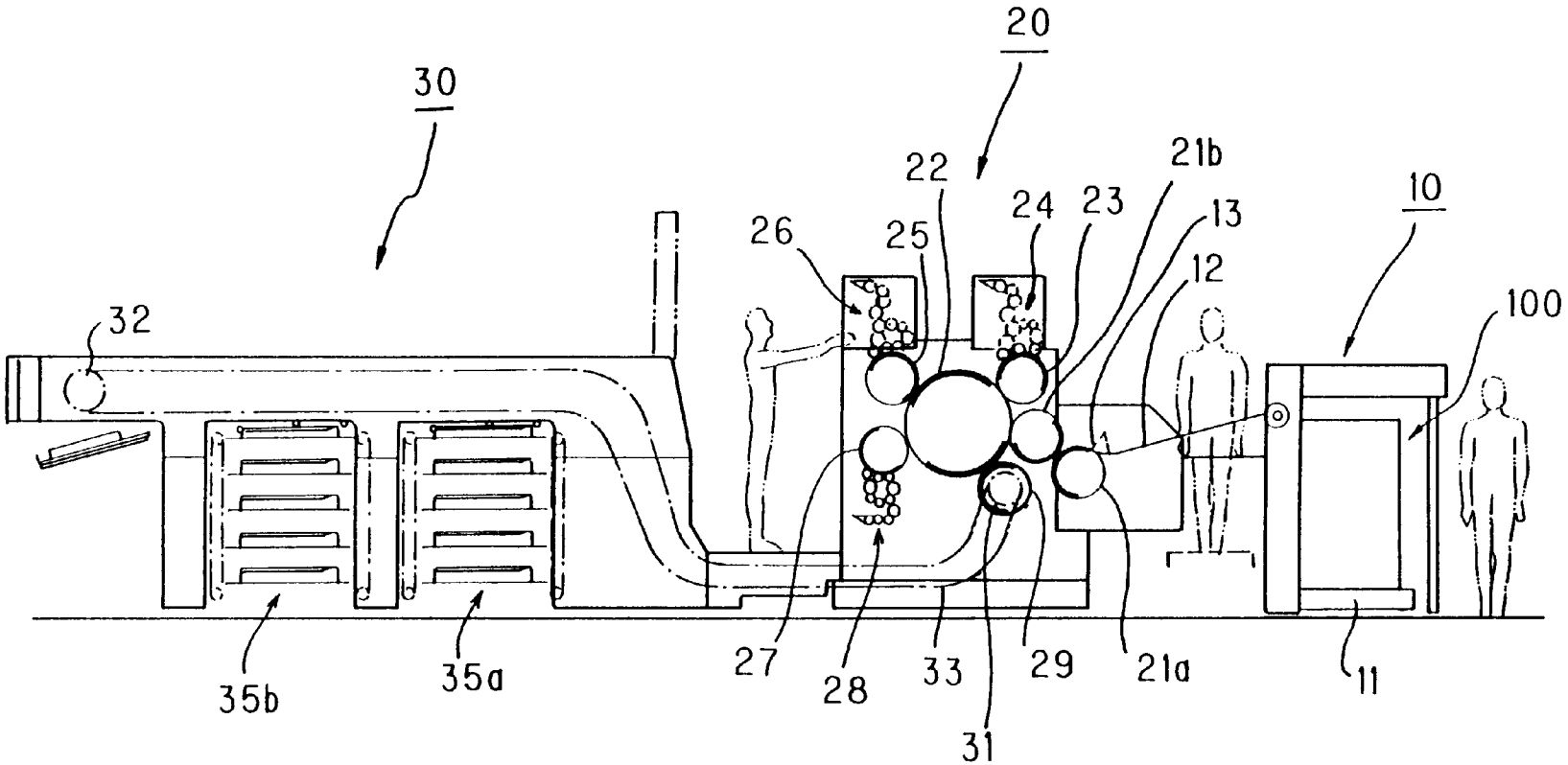
FIG. 1 is a schematic view of an outline of a whole of an embodiment of a printing machine in accordance with the present invention.
Figure 2:
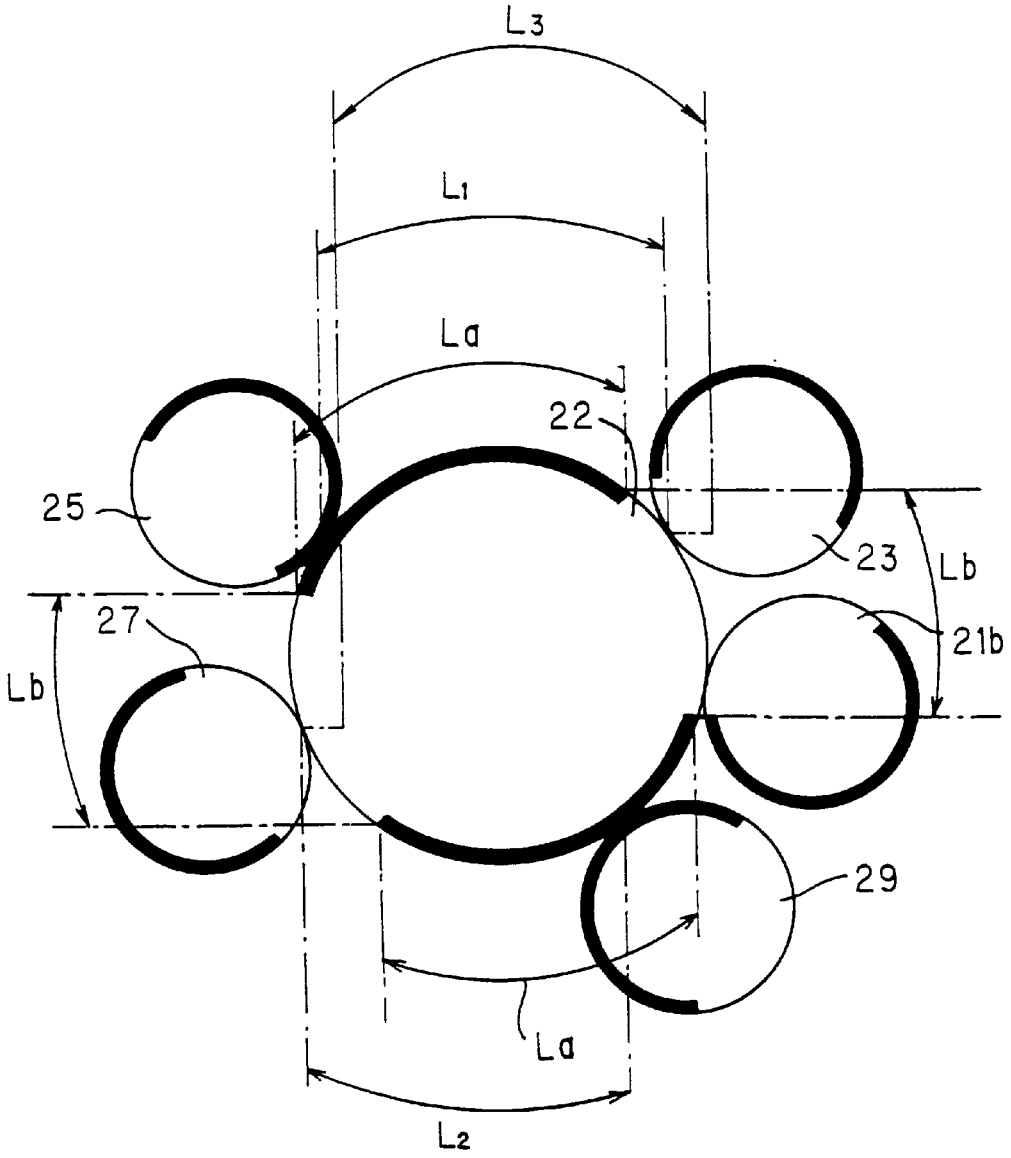
FIG. 2 is an enlarged view which extracts a main portion of FIG. 1.
Figure 3:
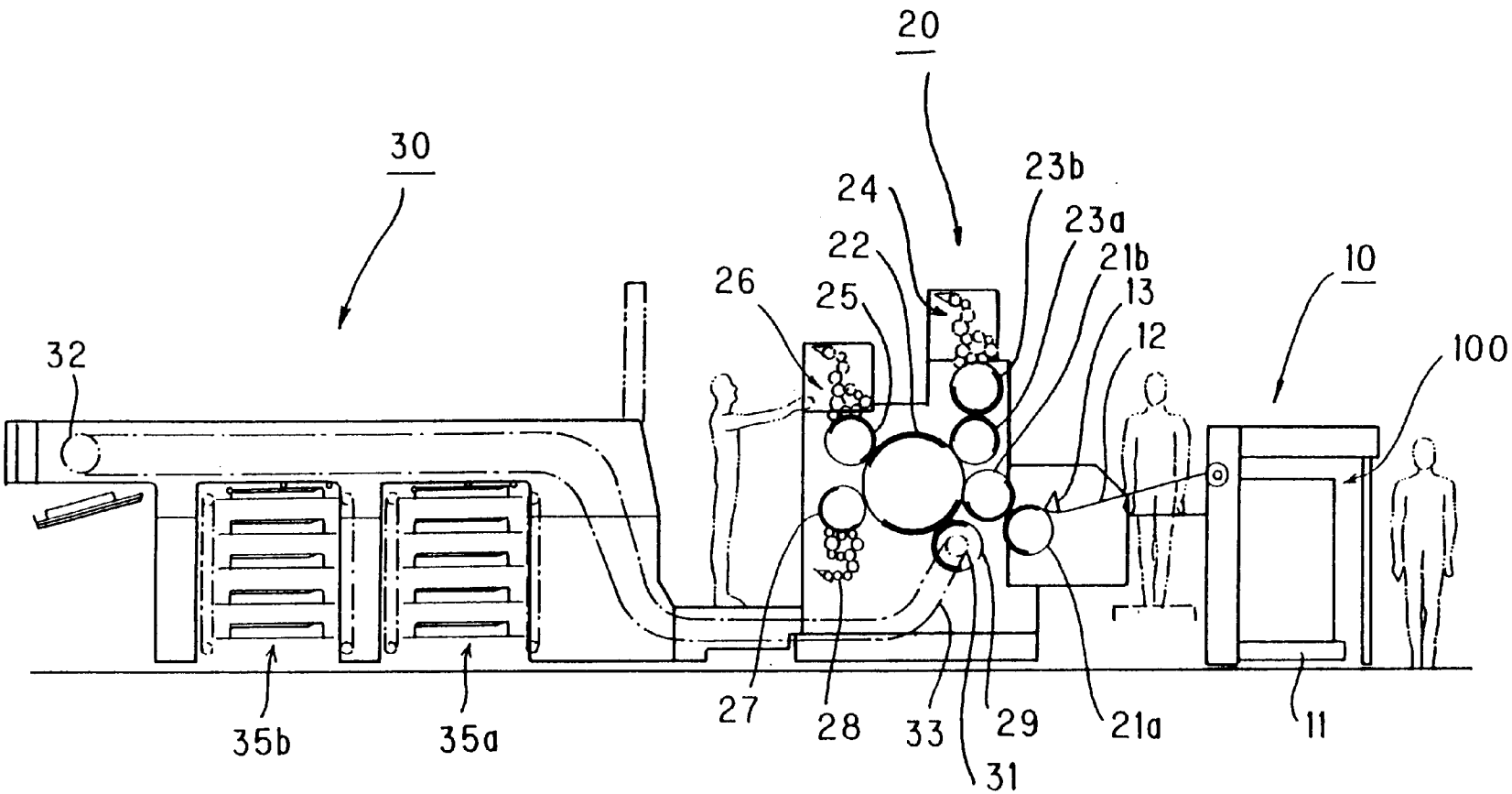
FIG. 3 is a schematic view of an outline of a whole of another embodiment of a printing machine in accordance with the present invention.

As shown in FIG. 1, a paper stack table 11 is provided in a paper supply portion 10. A feeder board 12 which supplies a sheet paper 100 corresponding to a sheet-like material on the paper stack table 11 to a printing portion 20 one by one is provided in the paper supply portion 10. A swing apparatus 13 which transfers the sheet paper to a transfer cylinder 21*a* is provided in a front end of the feeder board 12.

The transfer cylinder 21*a* is oppositely brought into contact with an impression cylinder 22 in the printing portion 20 via a transfer cylinder 21*b*. A letterpress stamp cylinder 23 for printing a stamp is oppositely brought into contact at a downstream side of the transfer cylinder 21*a* in a rotational direction of the impression cylinder 22 so that it can move near or move apart from the impression cylinder 22 (impression-on, impression throw-off). A group of rollers of an ink supply apparatus 24 are oppositely brought into contact with the stamp cylinder 23. A number cylinder 25 for printing a number is oppositely brought into contact with a downstream side of the stamp cylinder 23 in a rotational direction of the impression cylinder 22 so that it can move near or move apart from the impression cylinder 22 (impression-on, impression throw-off). A group of rollers of an ink supply apparatus 26 are oppositely brought into contact with the number cylinder 25. A number cylinder 27 for printing a number is oppositely brought into contact with a downstream side of the number cylinder 25 in a rotational direction of the impression cylinder 22, so that it can move near or move apart from the impression cylinder 22 (impression-on, impression throw-off). A group of rollers of an ink supply apparatus 28 are oppositely brought into contact at the number cylinder 27.

A paper discharge cylinder 29 corresponding to a transfer cylinder is oppositely brought into contact with a downstream side of the number cylinder 27 in a rotational direction of the impression cylinder 22.

In the present embodiment structured in this manner, a first printing portion is constituted by the stamp cylinder 23, the ink supply apparatus 24 and the like, a second printing portion is constituted by the number cylinder 25, the ink supply apparatus 26 and the like, and a number printing portion is constituted by the number cylinder 27, the ink supply apparatus 28 and the like.

In this case, the impression cylinder 22 is constituted by a plural diameter cylinder (a double diameter cylinder in the present embodiment) in which a plurality of effective surfaces (two surfaces in the present embodiment) (a black-painted portion in FIGS. 1 and 2, having substantially the same length as a length in a vertical direction of the sheet paper 100) for holding the sheet paper 100 are provided along a peripheral direction at a predetermined interval, and a notch portion provided with a gripping gripper and the like is formed between the adjacent effective surfaces. On the contrary, the transfer cylinders 21*a* and 21*b*, the stamp cylinder 23 and the number cylinders 25 and 27 are constituted by a single surface cylinder which has one effective surface and one notch portion.

Further, as shown in FIG. 2, a transfer distance L1 of the sheet paper 100 which is performed by the impression cylinder 22 between the oppositely contacting position between the stamp cylinder 23 and the impression cylinder 22 and the oppositely contacting position between the number cylinder 25 and the impression cylinder 22 has a length equal to or more than a length L0 in a transfer direction (a vertical direction) of a printing surface of the sheet paper 100 ($L1 \geqq L0$), a transfer distance L2 of the sheet paper 100 which is performed by the impression cylinder 22 between the oppositely contacting position between the number cylinder 27 and the impression cylinder 22 and the oppositely contacting position between the paper discharge cylinder 29 and the impression cylinder 22 has a length equal to or more than a length L0 in the transfer direction of the printing surface of the sheet paper 100 (L2≧L0), and a transfer distance L3 of the sheet paper 100 which is performed by the impression cylinder 22 between the oppositely contacting position between the stamp cylinder 23 and the impression cylinder 22 and the oppositely contacting position between the number cylinder 27 and the impression cylinder 22 has a length equal to or less than a length (La+2Lb) obtained by adding a length La of the effective surface of the impression cylinder 22 to twice a length La of the notch portion (L3≦La+2Lb). That is, after completion of printing a number on a certain sheet paper 100 by means of the number cylinder 27, printing a seal on a sheet paper subsequent to the next different sheet paper 100 by means of the stamp cylinder 23 is started. Therefore, the stamp for the next, different sheet paper 100 is not performed by means of the stamp cylinder 23 when a number is being printed on the certain sheet paper 100 by means of the number cylinder 27.

In the printing machine structured in the manner mentioned above, when the sheet paper 100 is transferred from the paper stack table 11 of the paper supply portion 10 to the transfer cylinder 21*a* via the feeder board 12, the sheet paper 100 is transferred to the impression cylinder 22 of the printing portion 20 via the transfer cylinder 21*b*, is printed the stamp by the stamp cylinder 23, is printed the number by the number cylinders 25 and 27, thereafter is gripped to the paper discharge gripper of the paper discharge portion 30 via the paper discharge cylinder 29, is transferred together with a travel of the paper discharge chain 33, and is discharged to the pile 35*a* and 35*b*.

Here, as described above, since the transfer distance L1 of the sheet paper 100 which is performed by the impression cylinder 22 between the oppositely contacting position between the stamp cylinder 23 and the impression cylinder 22 and the oppositely contacting position between the number cylinder 25 and the impression cylinder 22 has a length equal to or more than a length L0 in the transfer direction of a printing surface of the sheet paper 100 (L1≧L0), the number is printed on the sheet paper 100 by the number cylinder 25 after the stamp is printed on the sheet paper 100 by the stamp cylinder 23. Accordingly, the printing operation of the number by the number cylinder 25 is not affected by a slight vibration at a time of printing by the stamp cylinder 23, whereby it is possible to prevent a lost paper from being generated.

Further, since a transfer distance L2 of the sheet paper 100 which is performed by the impression cylinder 22 between the oppositely contacting position between the number cylinder 27 and the impression cylinder 22 and the oppositely contacting position between the paper discharge cylinder 29 and the impression cylinder 22 has a length equal to or more than a length L0 in the transfer direction of the printing surface of the sheet paper 100 (L2≧L0), the sheet paper is transferred and gripped from the impression cylinder 22 to the paper discharge cylinder 29 after the number is printed on the sheet paper 100 by the number cylinder 27. Accordingly, since a terminal end side of the sheet paper 100 is not tensioned to the side of the number cylinder 27 by an ink during the number printing, the paper discharge cylinder 29 can securely grip the sheet paper 100 and since the terminal end side of the sheet paper 100 is not tensioned to the side of the paper discharge cylinder 29 during the number printing, the number printing can be securely performed, whereby it is possible to prevent a lost paper from being generated.

Further, since a transfer distance L3 of the sheet paper 100 which is performed by the impression cylinder 22 between the oppositely contacting position between the stamp cylinder 23 and the impression cylinder 22 and the oppositely contacting position between the number cylinder 27 and the impression cylinder 22 has a length equal to or less than a length (La+2Lb) obtained by adding a length Lb of the effective surface of the impression cylinder 22 to twice a length Lb of the notch portion (L3<La+2Lb). That is, after completion of printing a number on a certain sheet paper 100 by means of the number cylinder 27, printing a seal on a sheet paper subsequent to the next different sheet paper 100 by means of the stamp cylinder 23 is started. Therefore, the stamp for the next, different sheet paper 100 is not performed by means of the stamp cylinder 23 when a number is being printed on the certain sheet paper 100 by means of the number cylinder 27.

Accordingly, for example, even when the number cylinder 27 generates a poor number transfer, it is possible to easily stop the sheet paper 100 two sheet after the sheet paper 100 having the poor number transfer without printing the stamp and the number by immediately retracting (impression throw-off) the stamp cylinder 23 and the number cylinders 25 and 27. Further, since it is possible to stop the printing at a time when a good number printing is finished by the number cylinder 25 with respect to the sheet paper 100 one sheet after the sheet paper having the poor number transfer, it is possible to treat the sheet paper as a normal paper not as a lost paper only by printing the number by means of the number cylinder 27 after inspecting and correcting the number cylinder 27. Accordingly, it is possible to restrict the sheet paper 100 having the poor printing to only one sheet, so that it is possible to restrict the generation of the lost paper.

Accordingly, in accordance with the printing machine mentioned above, it is possible to restrict the loss of the sheet paper 100 as much as possible.

Figure 4:
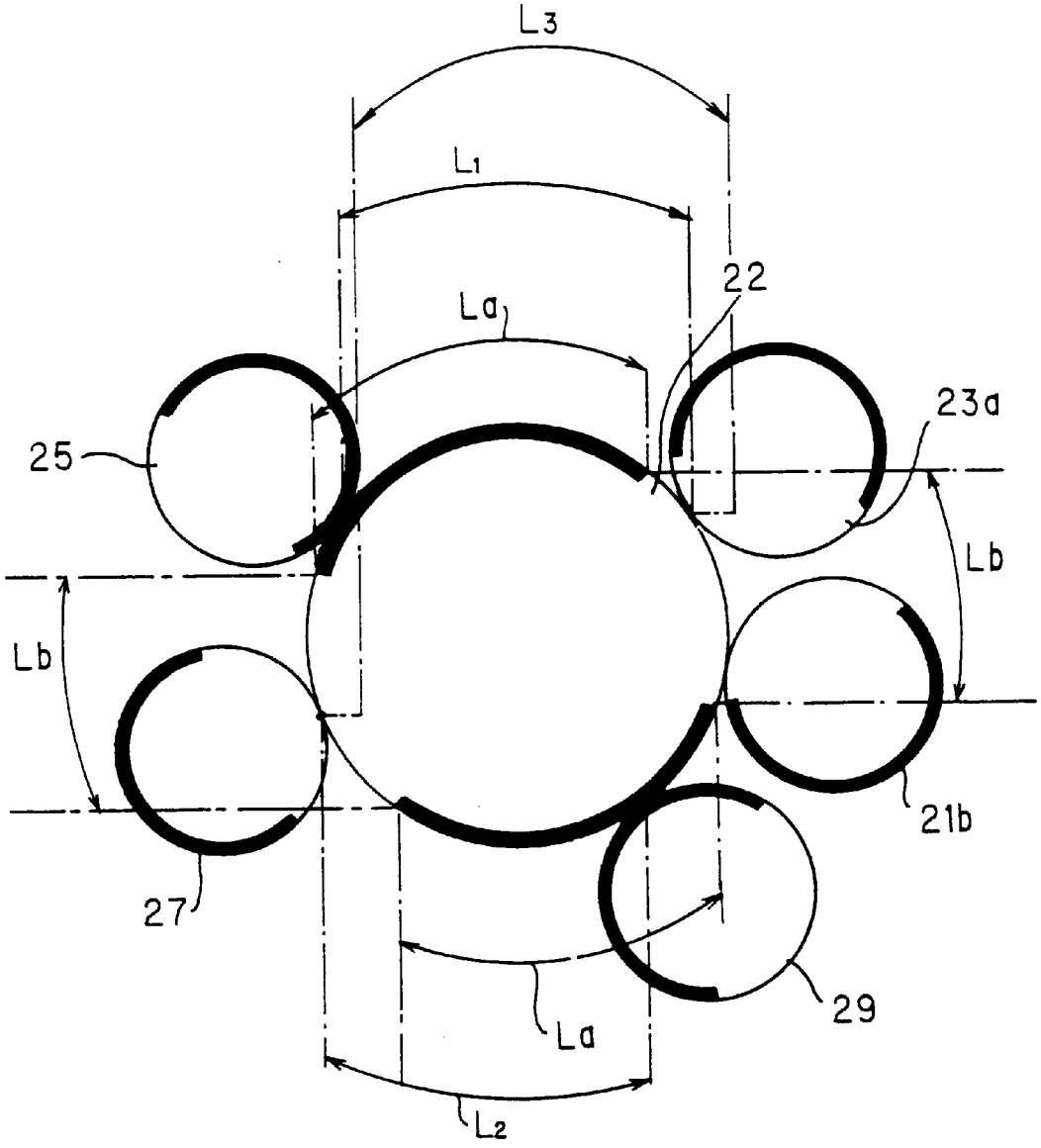
FIG. 4 is an enlarged view which extracts a main portion of FIG. 3.
Figure 5:
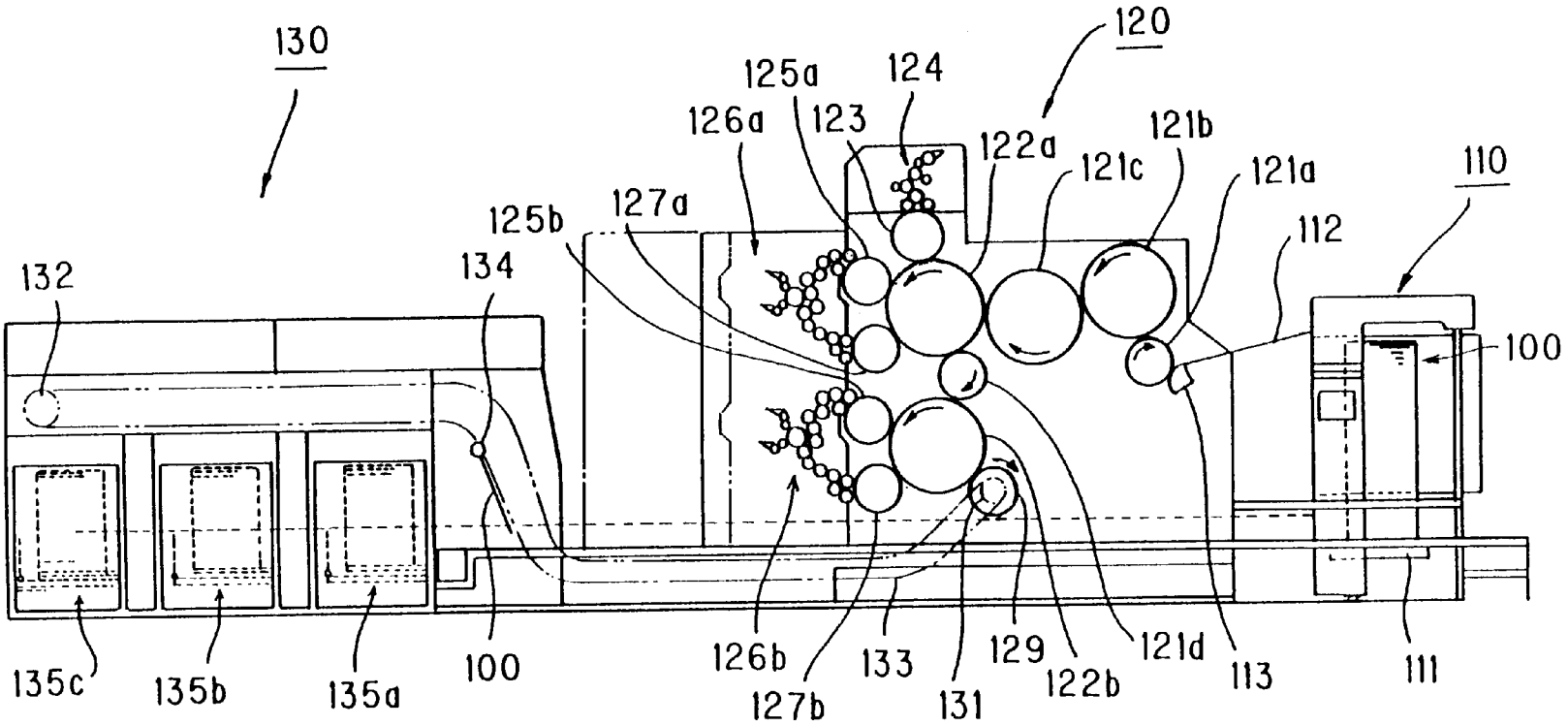
FIG. 5 is a schematic view of an outline of a whole of an embodiment of a printing machine in accordance with the conventional art.

Incidentally, in the above embodiment, the structure is made such that the stamp is directly printed from the letterpress printing cylinder 23. However, the structure may be made, for example, such that the stamp is offset printed from a plate cylinder 23*b* via a blanket cylinder 23*a*. In this case, in place of the oppositely contacting position between the stamp cylinder 23 and the impression cylinder 22, as shown in FIG. 4, an oppositely contacting position between the blanket cylinder 23*a* and the impression cylinder 22 should be considered.

Further, in the above embodiment, the structure is made such that the paper discharge cylinder 29 is applied to the transfer cylinder, thereby discharging the sheet paper 100 from the paper discharge cylinder 29 to the piles 35*a* and 35*b* of the paper discharge portion 30 via the paper discharge chain 33. However, the structure may be made, for example, such that a transfer cylinder is applied to another transfer cylinder, and the sheet-like material is transferred to the paper discharge cylinder via one or a plurality of transfer cylinders or the sheet-like material is transferred to the paper discharge cylinder or the sheet-like material is transferred to a new printing portion via one or a plurality of transfer cylinders.

Further, in the above embodiment, the second printing portion is constituted by the number cylinder 25, the ink supply apparatus 26 and the like. However, the second printing portion can be constituted by a general plate cylinder for printing a general pattern, an ink supply apparatus and the like.

Further, in the above embodiment, the double diameter impression cylinder 22 is employed. However, it is possible to employ an impression cylinder having three times or more of cylinder diameter. Here, in the case that the impression cylinder is the double diameter cylinder, an angle formed by a line obtained by linearly connecting the oppositely contacting position between the first printing portion and the impression cylinder to an axial center of the impression cylinder, and a line obtained by linearly connecting the oppositely contacting position between the number printing portion and the impression cylinder 22 to the axial center of the impression cylinder is equal to or less than 180 degrees.

In accordance with the printing machine of the present invention, it is possible to restrict the loss of the sheet-like material as much as possible.

What is claimed is:

1. A printing machine comprising:

a rotatable impression cylinder which has a plurality of effective surfaces for holding a sheet-like material along a peripheral direction at a predetermined interval;

a first printing portion which is oppositely brought into contact with said impression cylinder and applies a printing to said sheet-like material;

a second printing portion which is oppositely brought into contact with said impression cylinder in a downstream side in a rotational direction of said impression cylinder with respect to an oppositely contacting position of said first printing portion with said impression cylinder and applies a printing to said sheet-like material;

a number printing portion which is oppositely brought into contact with said impression cylinder in a downstream side in the rotational direction of said impression cylinder with respect to an oppositely contacting position of said second printing portion with said impression cylinder and applies a number printing to said sheet-like material; and a transfer cylinder which is oppositely brought into contact with said impression cylinder in a downstream side in a rotational direction of said impression cylinder with respect to an oppositely contacting position of said number printing portion with said impression cylinder and receives said sheet-like material from said impression cylinder, wherein said first printing portion, said second printing portion, said number printing portion and said transfer cylinder are respectively arranged so that a transfer distance of said sheet-like material which is defined by said impression cylinder between the oppositely contacting position between said first printing portion and said impression cylinder and the oppositely contacting position between said second printing portion and said impression cylinder has a length equal to or more than a length in a transfer direction of a printing surface of said sheet-like material, and a transfer distance of said sheet-like material which is performed by said impression cylinder between the oppositely contacting position between said number printing portion and said impression cylinder and an oppositely contacting position between said transfer cylinder and said impression cylinder has a length equal to or more than the length in a transfer direction of an printing surface of said sheet-like material and a transfer distance of a sheet-like material which is performed by said impression cylinder between the oppositely contacting position between said first printing portion and said impression cylinder and the oppositely contacting position between said number printing portion and said impression cylinder has a length equal to or less than a length obtained by adding twice a length between adjacent effective surfaces of said impression cylinder to a length of said effective surface.

2. A printing machine as claimed in claim 1, wherein said impression cylinder is a plural diameter cylinder which has a plurality of effective surfaces for holding said sheet-like material along a peripheral direction at a predetermined interval, and each of the cylinders in said first printing portion, said second printing portion and said number printing portion which are oppositely brought into contact with said impression cylinder is a single surface cylinder which has a single effective surface.

3. A printing machine as claimed in claim 2, wherein said second printing portion applies a number printing to said sheet-like material.

4. A printing machine as claimed in claim 1, wherein an angle formed by a line obtained by linearly connecting the oppositely contacting position between said first printing portion and said impression cylinder to an axial center of said impression cylinder, and a line obtained by linearly connecting the oppositely contacting position between said number printing portion and said impression cylinder to the axial center of said impression cylinder is equal to or less than 180 degrees.

* * * * *